US008281866B2

(12) United States Patent
Tessier et al.

(10) Patent No.: US 8,281,866 B2
(45) Date of Patent: Oct. 9, 2012

(54) PRODUCTION TUBING DRAIN VALVE

(75) Inventors: Lynn P. Tessier, Eckville (CA); John P. Doyle, Calgary (CA)

(73) Assignee: MSI Machineering Solutions Inc., Providenciales (TC)

( * ) Notice: Subject to any disclaimer, the term of this patent is extended or adjusted under 35 U.S.C. 154(b) by 388 days.

(21) Appl. No.: 12/726,044

(22) Filed: Mar. 17, 2010

(65) Prior Publication Data

US 2010/0282476 A1 Nov. 11, 2010

Related U.S. Application Data

(60) Provisional application No. 61/176,980, filed on May 11, 2009.

(51) Int. Cl.
*E21B 34/06* (2006.01)

(52) U.S. Cl. ..... 166/373; 116/319; 137/107

(58) Field of Classification Search ..... 166/373, 166/374, 319, 334.3, 334.4; 251/73, 333; 137/107, 511, 517

See application file for complete search history.

(56) References Cited

U.S. PATENT DOCUMENTS

| | | | | |
|---|---|---|---|---|
| 2,397,492 | A * | 4/1946 | Koning | 33/567.1 |
| 2,610,859 | A * | 9/1952 | Wilcox et al. | 137/102 |
| 3,034,527 | A * | 5/1962 | Hennells | 137/102 |
| 3,967,635 | A * | 7/1976 | Sealfon et al. | 137/102 |
| 4,427,070 | A * | 1/1984 | O'Brien | 166/317 |
| 6,289,990 | B1 * | 9/2001 | Dillon et al. | 166/319 |
| 8,056,575 | B2 * | 11/2011 | Hsu | 137/107 |

* cited by examiner

*Primary Examiner* — Daniel P Stephenson
(74) *Attorney, Agent, or Firm* — Sheridan Ross P.C.

(57) ABSTRACT

A tubing drain valve in a production tubing string, positioned above a pump, is operated to open drain ports in the housing for draining produced fluids from the production tubing when the pump is shut off. The drain valve incorporates a check valve assembly which is freely moveable within the drain valve to shift a sleeve to open and close the drain ports. An uphole end of the check valve assembly is above the sleeve and seals to the top of a sleeve to shift the sleeve downhole and open the drain ports. A downhole end of the check valve is positioned below the sleeve in the valve. When the pump is turned on, the downhole end of the check valve assembly moves uphole to seal to the sleeve, creating a positive force to lift the sleeve to block the drain ports. The produced fluids flow through the valve and the production tubing to surface. The positive force minimizes the effect of fouling of the valve due to debris above the valve which might otherwise result in failure to shift the sleeve uphole, leaving the drain ports open.

13 Claims, 12 Drawing Sheets

PRODUCTION TUBING DRAIN VALVE

CROSS-REFERENCE TO RELATED APPLICATIONS

This application is a non-provisional application claiming priority of U.S. Provisional Patent application Ser. No. 61/176,980 filed May 11, 2009, the entirety of which is incorporated herein by reference.

FIELD OF THE INVENTION

Embodiments of the invention are related to valves used in production tubing fluidly connected to submersible pumping assemblies and more particularly, to valves positioned above the submersible pumping assembly to drain fluid from the production tubing to the annulus when the pumping assembly is shutdown.

BACKGROUND OF THE INVENTION

Submersible pumping assemblies such as progressive cavity pumps and centrifugal pumps are suspended downhole in a wellbore by a string of production tubing. During pumping, fluid is discharged up the production tubing by the pump. When the pump stops, either intentionally or as a result of a failure of the pumping assembly, fluid in the production tubing string may flow back down into the pump causing the pump to reverse and potentially causing debris in the fluid to enter the pump. The debris remains in the pumping assembly and, when the pump is restarted, may cause damage to the pumping assembly.

Alternatively, in the case where an operator wishes to pull the pump and the production tubing from the wellbore, such as for servicing of the pumping assembly, the pump and production tubing may pack off resulting in fluid remaining in the production tubing. In order to reduce the weight of the loaded production tubing for extraction from the wellbore, a bailing operation may be required which is both costly and time consuming.

It is known to provide a valve above the discharge of an electrical submersible pump for draining the tubing above the pump when the pump shuts down. U.S. Pat. No. 6,289,990 to Baker Hughes Incorporated teaches a tubing shunt valve which is pressure actuated between a sealed position, wherein fluid communication between the production tubing and an annulus thereabout via shunt ports is prevented, and a drain position, wherein fluid is drained from the production tubing above the pump through shunt ports into the annulus. The Baker Hughes valve utilizes a single diameter valve cage having a seal interface which shifts across the shunt ports when moving between the sealed and drain positions. The Baker Hughes valve utilizes a spring biased valve head and shaft forming a piston which is confined within a bore in the valve cage. The valve head seals against a valve seat formed in the valve cage in the drain position. The valve seat is in fluid communication with the discharge of the pump therebelow. The shifting of the sleeve to the sealed or production position is reliant upon a friction resistance to shifting of the valve cage being less than a fluid force required to open the valve head when biased to the drain position. Applicant believes that any additional resistance due to fouling could prevent shifting of the valve cage to seal the shunt ports even though the pump may have overcome the biasing spring to cause the valve head to unseat and fluid to pass through the valve seat and the plurality of axial passages in the valve cage.

Further, the spring which biases the valve head must be matched to the depth of the well as a result of increasing hydrostatic pressure and therefore many iterations of the valve are required for use in wells of different depths.

There is a need for a drain valve which reliably seals the shunt ports through repeated movement of the valve between the sealed and drain positions and which is reliably and rapidly actuated between the sealed production position and the drain position when required.

SUMMARY OF THE INVENTION

A tubing drain valve utilizes a first check valve positioned below a sleeve which is axially moveable in a housing, to form a downhole piston face. Pumped fluid, acting at the downhole piston face, result in a significant positive force to lift the sleeve to block one or more drain ports in the housing, in a production position. Thus, the valve does not rely upon overcoming a biasing force to permit fluid communication with the formation and is less prone to fouling. The valve therefore minimizes failures to shift the sleeve to block the one or more drain ports in the production position.

A second check valve is positioned above the sleeve for forming an uphole piston face when sealed against the sleeve. Produced fluid in the production tubing, upon stopping the pump, acts at the uphole piston face for shifting the sleeve downhole to open the one or more drain ports. The fluids are drained through the one or more drain ports to the annulus.

In one broad aspect therefore, a tubing drain valve for incorporation between a production tubing string and a pump, the tubing drain valve comprising: a housing having an uphole end for connection to the production tubing string above the pump and a downhole end for connection to the pump, downhole of the housing, the housing having a valve bore in communication with fluid in the tubing string and the pump; one or more drain ports in the housing communicating with the valve bore; a sleeve fit to the valve bore and being axially moveable in a reciprocating action in the valve bore, the sleeve having a central bore therethrough; a first check valve positioned downhole of the sleeve for sealing the central bore at a downhole end of the sleeve for forming a downhole piston face, fluid from the pump acting thereat to lift the sleeve uphole to block the one or more drain ports in a production position; and unsealing from the central bore for permitting fluid to flow therethrough in the production position; a second check valve positioned above the sleeve for unsealing from the central bore at an uphole end of the sleeve for permitting fluid to flow therethrough in the production position; and sealing the central bore for forming an uphole piston face, fluid in the production tubing string thereabove acting thereat to move the sleeve downhole to open the one or more drain ports in a drain position for draining fluid from the production tubing string therethrough.

The first and second check valves are spaced by a valve stem for forming a check valve assembly which is freely, axially moveable in the sleeve. Spacing of a stop and an uphole shoulder in the housing permits the check valve assembly's axial, uphole movement to be stopped at the stop before the sleeve's axial, uphole movement is stopped by the uphole shoulder. This causes the first and second check valves to be unsealed from the sleeve for permitting uphole flow of fluids thereby in the production position.

In another broad aspect of the invention, a method for operating a tubing drain valve, positioned between a production tubing string and a pump, for blocking one or more drain ports in a valve housing in a production position for producing fluid through a valve bore in the housing when the pump is operating and opening the one or more drain ports in a drain position for draining fluid from the production tubing when the pump is stopped, the method comprising: receiving fluid from the pump when operating the pump to flow fluid uphole; shifting a first check valve axially uphole to seal a central bore of a sleeve housed in the valve bore at a downhole end of the sleeve, for forming a downhole piston face; the fluid acting at the downhole piston face; lifting the sleeve to move axially uphole within the valve bore to block the one or more drain ports in the production position, arresting the uphole movement of the first check valve; and lifting the sleeve to unseal at least the first check valve from the central bore to permit the fluid to flow therethough receiving fluid from the production tubing when the pump is stopped for ceasing the flow of fluid uphole; moving a second check valve downhole to seal the central bore at an uphole end of the sleeve and for forming an uphole piston face, fluid in the production tubing thereabove acting at the uphole piston face; and shifting the sleeve downhole to open the one or more drain ports in the drain position.

Advantageously, providing a seal which remains above the drain ports and a seal which remains below the drain ports extends the life of the seals as damage due to engagement of the seals with the drain ports is avoided.

BRIEF DESCRIPTION OF THE DRAWINGS

FIG. 1A illustrates a valve cage shifted downhole sufficient to open shunt ports in a production tubing string and a piston therein biased to a downhole position for sealing a valve seat in the valve cage fluidly connected to a formation therebelow, fluid from the production tubing being drained through the shunt ports to an annulus;

FIG. 1B illustrates the valve cage shifted to an uphole position for closing the shunt ports and the valve head remaining biased to the downhole position for preventing flow therethrough from the formation below; and FIG. 1C illustrates the valve cage in the uphole position for closing the shunt ports and the valve head shifted to a uphole production position by pressure from the pump therebelow for opening the valve seat to permit fluid flow to the production tubing string thereabove;

FIG. 10A illustrates the free floating check valve assembly, after pumping has stopped, having been moved axially downhole by pressure in the tubing string, to seat an uphole end of the check valve assembly to an uphole end of the sleeve for forming an uphole piston face;

FIG. 10B illustrates the drain valve in a drain position, the uphole piston face having been acted on by the pressure of the fluids in the tubing to move the check valve assembly and sleeve downhole to a maximum extent within the housing for opening the drain ports to the annulus;

FIG. 10C illustrates the drain valve when pumping is started, the check valve assembly being shifted axially uphole to seat the downhole end at a downhole end of the sleeve for forming a downhole piston face, the downhole end of the check valve assembly preventing fluid flow from the pump discharge therethrough;

FIG. 10D illustrates the pump discharge pressure acting on the downhole piston face for shifting the free floating check valve assembly and sleeve axially uphole to close the drain ports;

FIG. 10E illustrates the pump discharge pressure continuing to act on the downhole piston face for shifting the free floating check valve assembly axially to a maximum extent for sealing the sleeve to the housing above the drain ports and thereafter engaging an uphole end with a tag bar in the housing, the downhole end of the check valve assembly preventing fluid flow from the formation therethrough; and FIG. 10F illustrates the drain valve in a production position, the sleeve shifted axially to a maximum extent, an uphole end of the sleeve engaging a shoulder in the housing and the downhole end of the check valve assembly being spaced below the downhole end of the sleeve for permitting fluid flow therethrough from the formation to the production tubing string.

DETAILED DESCRIPTION OF THE PREFERRED EMBODIMENTS

Drain valves according to embodiments of the invention provide a positive force for shifting a sleeve to close drain ports in a housing when the drain valve is shifted from a drain position to a production position. Thus, the drain valve more reliably closes the drain ports even when there is debris positioned above the sleeve which typically contributes to fouling of prior art valves.

In order to understand the unique and distinctive aspects of embodiments of the invention, a more detailed description of the general principles of a known prior art drain valve are first set forth. Embodiments of the present invention are described thereafter.

PRIOR ART

As noted in the Background of the Invention herein, U.S. Pat. No. 6,289,990 to Baker Hughes Incorporated teaches a tubing shunt valve 10.

Figure 1C:
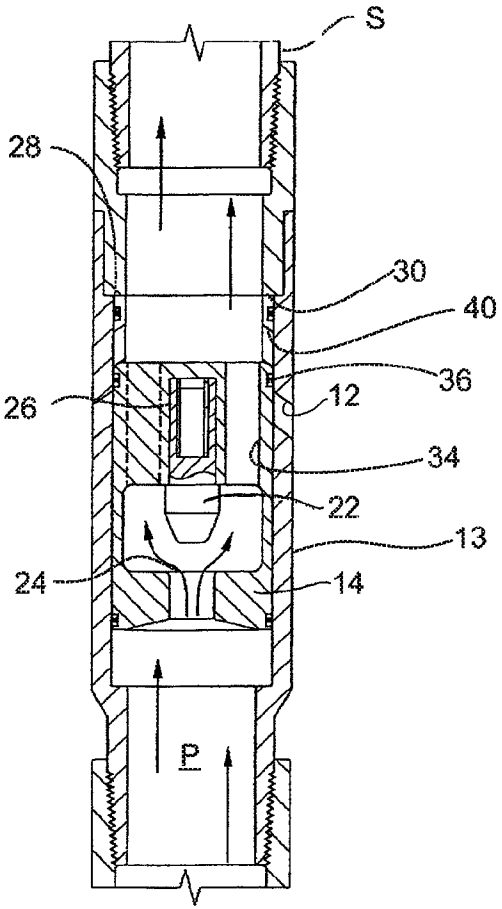
Fig. 1C PRIOR ART
FIGS. 1A-1C are longitudinal sectional views of a prior art drain valve illustrating the sequential action of the valve, more specifically.
Figure 1B:
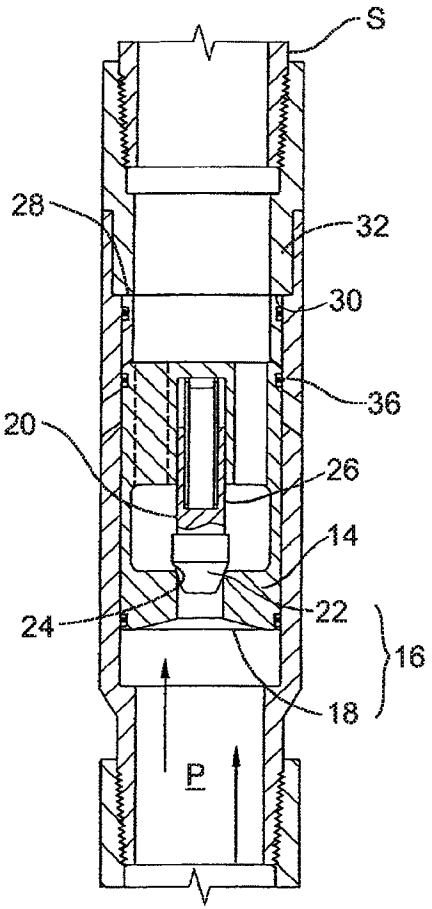
Fig. 1B PRIOR ART
Figure 1A:
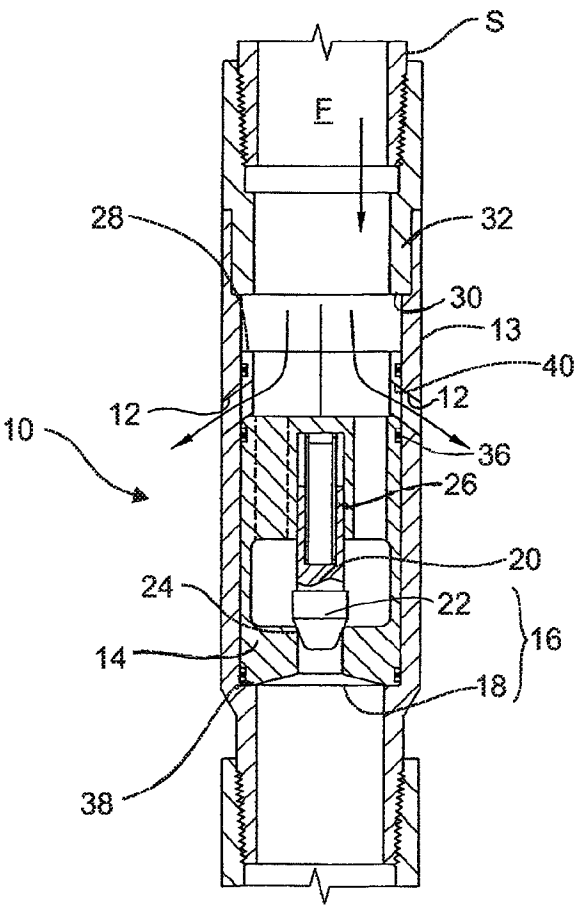
Fig. 1A PRIOR ART

In operation, as shown in FIGS. 1A-1C, when a pump (not shown) connected to a production tubing string S below the shunt valve 10 begins to operate (FIG. 1B), fluid pressure P generated by the pump closes shunt ports 12 in a body 13 of the tubing shunt valve 10. A valve cage 14, having a consistent hydrodynamic diameter, is forced upwards. The pressure P, downhole from the valve 10, acts against a piston 16, formed by the combination of a lower end 18 of the valve cage 14 and a spring-biased valve member 20 having a valve head 22, housed therein. The valve head 22 initially closes a valve seat 24 (FIG. 1B) in the valve cage 14. Produced fluid does not initially pass uphole through valve cage 14 because the valve head 22 is biased into sealing engagement with the valve seat 24 by a spring 26.

The valve cage 14 moves upwards until an upper end 28 abuts an upper interior rim 30 formed on an upper collar 32 in the valve body 13. A seal 36 positioned below the shunt ports 12 is slid over the shunt ports 12 as the valve cage 14 slides over the shunt ports 12. A lower seal 37 positioned at a downhole end of the valve cage 14 remains below the shunt ports, thus sealing the shunt ports 12.

The valve cage 14 abutting the upper interior rim 30 is no longer capable of further upward motion. Continued fluid pressure P from the pump therebelow overcomes the spring 26 (FIG. 1C) forcing the valve member 20 and valve head 22 to move upward out of sealing engagement with the valve seat 22 in a production position. Well fluid then passes through the valve seat 24 and upwards through passages 34 in the valve cage 14 and through the production tubing S thereabove. When the valve cage 14 is in the production position, the shunt ports 12 in the valve body 13 are closed by the valve cage 14. The resulting closed shunt valve 10 prevents communication between the production tubing and an annulus between the production tubing S and casing in the wellbore.

When the pump is shut down, a static column of produced fluid F is within the tubing above the shunt valve 10. As the pump is shut down, fluid pressure P no longer acts upwards against the valve head 22. The spring 26 biases the valve head 22 downward until the valve head 22 is in sealing engagement with the valve seat 24, once again forming the piston 16. The static column of produced fluid F opens the shunt valve 10 by forcing the valve cage 14 downward until the lower end 18 of valve cage 14 engages a lower interior rim 38 in the valve body 13 (FIG. 1A). When the valve cage 14 is in this lower, drain position, openings 40 in the valve cage 14 are in alignment with the shunt ports 12. Produced fluid F is allowed to drain through the aligned ports 12, 40 to empty into the annulus. The produced fluid F will continue to flow out of the shunt ports 12 into the well annulus until pressure within the tubing string S and the annular area are equalized.

Applicant believes that it is apparent that if there is any resistance to movement of the valve cage 14, due to debris in the produced fluid, the spring biased valve head 22 will open before the valve cage 14 moves and blocks the shunt ports 12, thus rendering the shunt valve 10 inoperative.

Embodiments of the Invention

In a drain valve, according to embodiments of the invention, the valve cage of the prior art is replaced by a tubular piston or sleeve which is axially moveable within a housing. The biased valve member of the prior art is replaced by a first check valve and a second check valve which engage downhole and uphole ends of the sleeve, respectively, for forming downhole and uphole piston faces for moving the sleeve axially within the housing to block and open drain ports in the housing, as described herein.

In greater detail and having references to FIGS. 2A-9, the valve 100 comprises, a housing 110 having a valve bore 112 therethrough. The valve bore 112 is in fluid communication with a string of production tubing thereabove and with a pump positioned therebelow. The production tubing and the pump are not illustrated but are well known. A tubular sleeve 114 is housed within the housing 110 and has a central bore 116 formed therethrough. The sleeve 114 is axially moveable in a reciprocating action within the housing 110. The sleeve 114 moves uphole to block one or more drain ports 118 in the housing 110 in the production position when the pump is operating and moves downhole to open the one or more drain ports 118 in a drain position to drain produced fluid F from the production tubing. When the pump is stopped, the fluid F flows through the one or more drain ports 118 to an annulus between the production tubing and wellbore casing.

As shown in FIGS. 2A-4 and FIGS. 10A-10F, a first check valve 120 is positioned below a downhole end 122 of the sleeve 114. The first check valve 120 is axially moveable in the valve's bore 112 below the sleeve 114. When the first check valve 120 is caused to move uphole to engage the sleeve's downhole end 122, a downhole piston face DH is formed and the central bore 116 of the sleeve 114 is sealed. Discharge of fluid from the pump acts at the downhole piston face DH, creating a force to move the sleeve 114 uphole to block the one or more drain ports 118. Uphole movement of the first check valve 120 is arrested and the sleeve 114 is caused to move further uphole to unseal from the first check valve 120 for opening the central bore 116 of the sleeve 114, permitting fluids to flow thereby into the production tubing thereabove, in the production position.

A second check valve 124 is positioned above the sleeve 114 and is unsealed from the sleeve 114 in the production position to permit fluids to flow thereby. When the pump is stopped, the second check valve 124 falls through gravity or is caused to move downhole to engage an uphole end 126 of the sleeve 114, forming an uphole piston face UH. The central bore 116 of the sleeve 114 and the housing 110 therebelow are sealed by the uphole piston face UH, preventing fluid to flow thereby to the pump below. The hydraulic head of the fluid F in the production tubing acts at the uphole piston face UH, creating a force to move the sleeve 114 axially downhole, opening the one or more drain ports 118 in the drain position. The fluid F drains out of the valve bore 112 through the one or more drain ports 118 to the annulus.

Having reference again to FIGS. 2A-4, and in an embodiment of the invention, the first and second check valves 120, 124 are connected and spaced apart by a valve stem 128 for forming a free floating check valve assembly 130. The valve stem 128 has a length longer in a length of the sleeve 114 so as to space the first check valve 120 from the second check valve 124 and permit both first and second check valves 120, 124 to be unsealed from the sleeve 114 in the production position.

Figure 5:
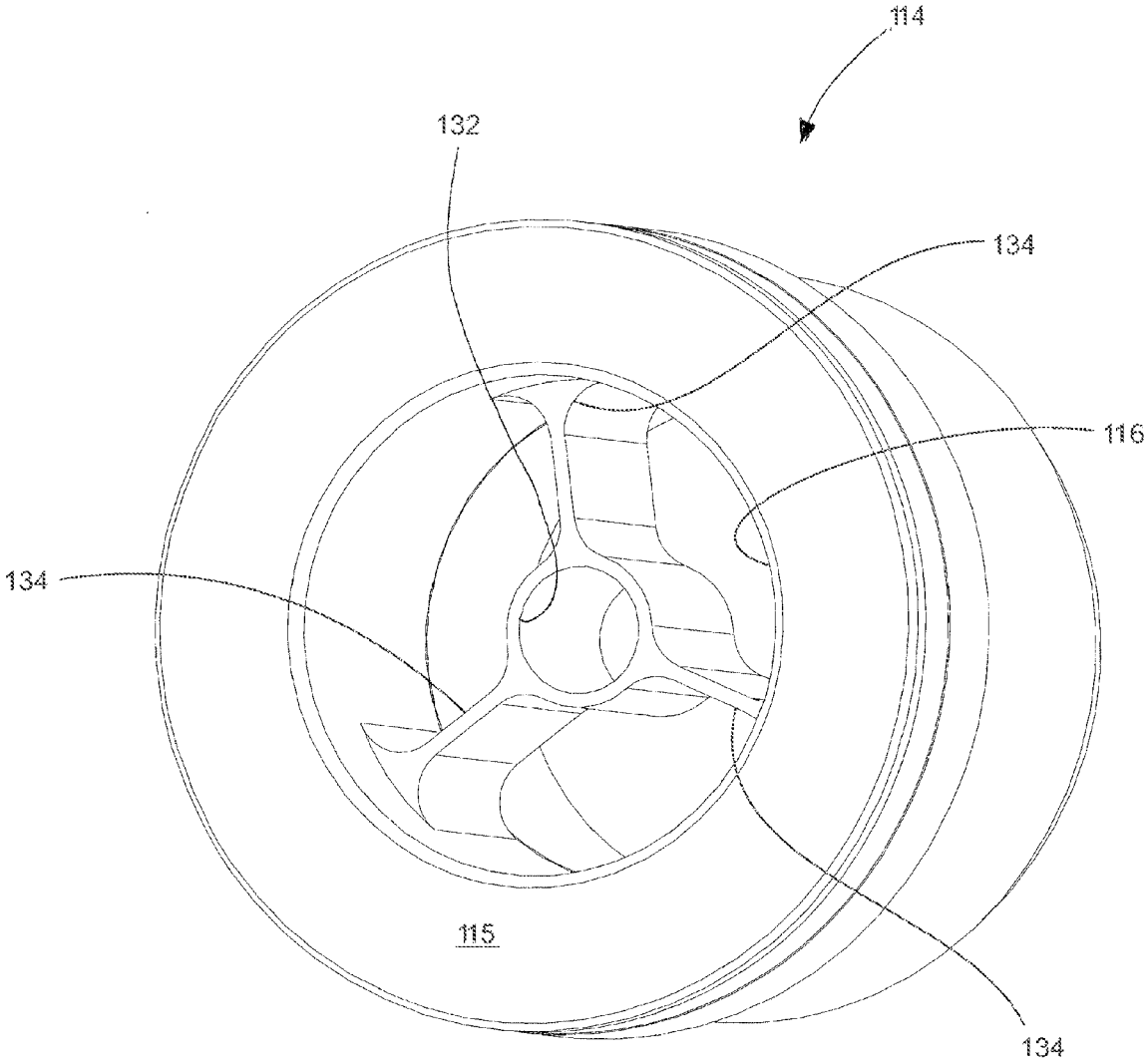
FIG. 5 is a perspective plan view of a sleeve axially moveable within a housing of the drain valve according to FIG. 2A illustrating a central support through which the free floating check valve assembly is mounted and a plurality of ports thereabout through which fluid is permitted to flow in a production position.
Figure 6:
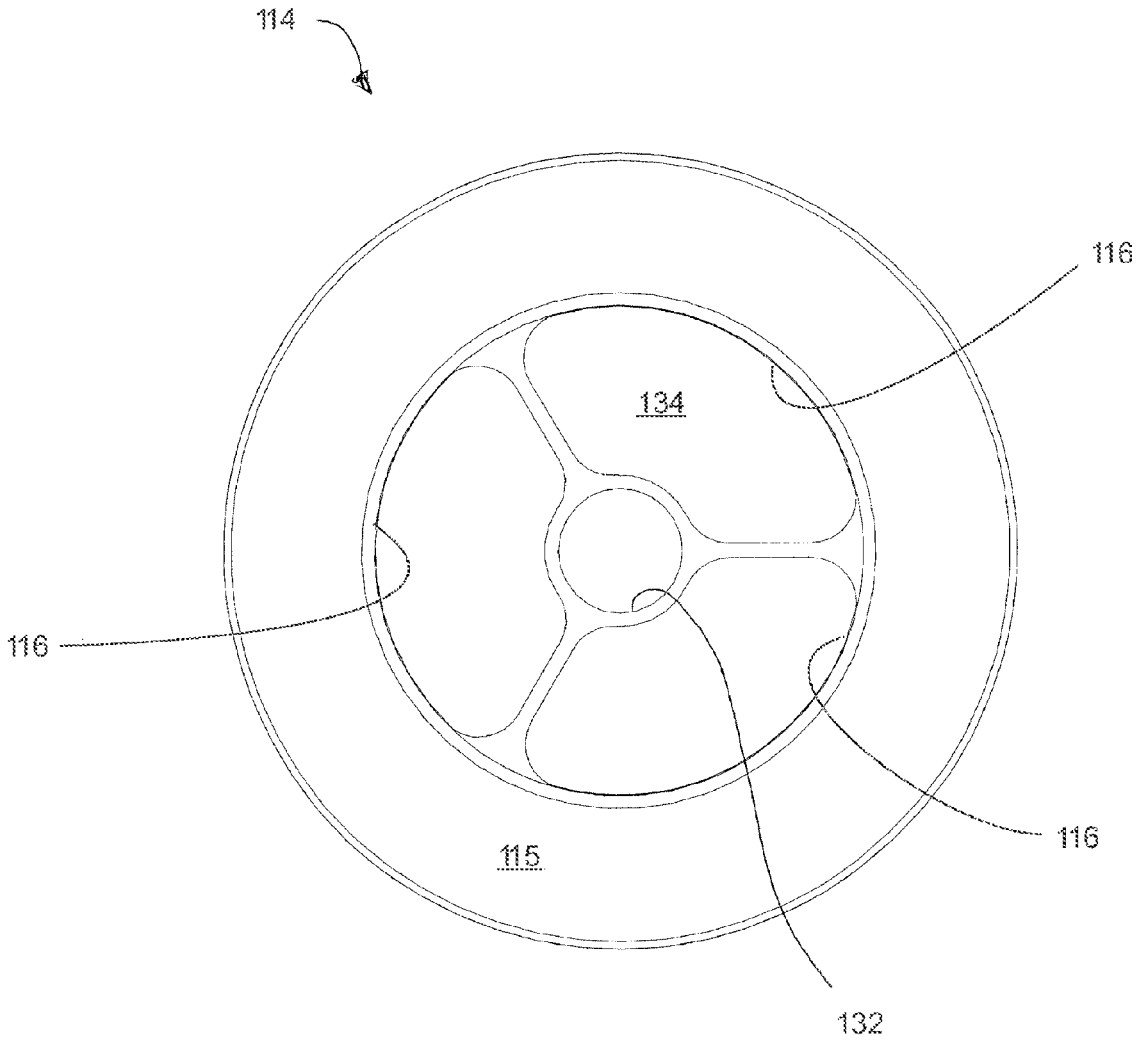
FIG. 6 is a plan view of the sleeve of FIG. 5.
Figure 7:
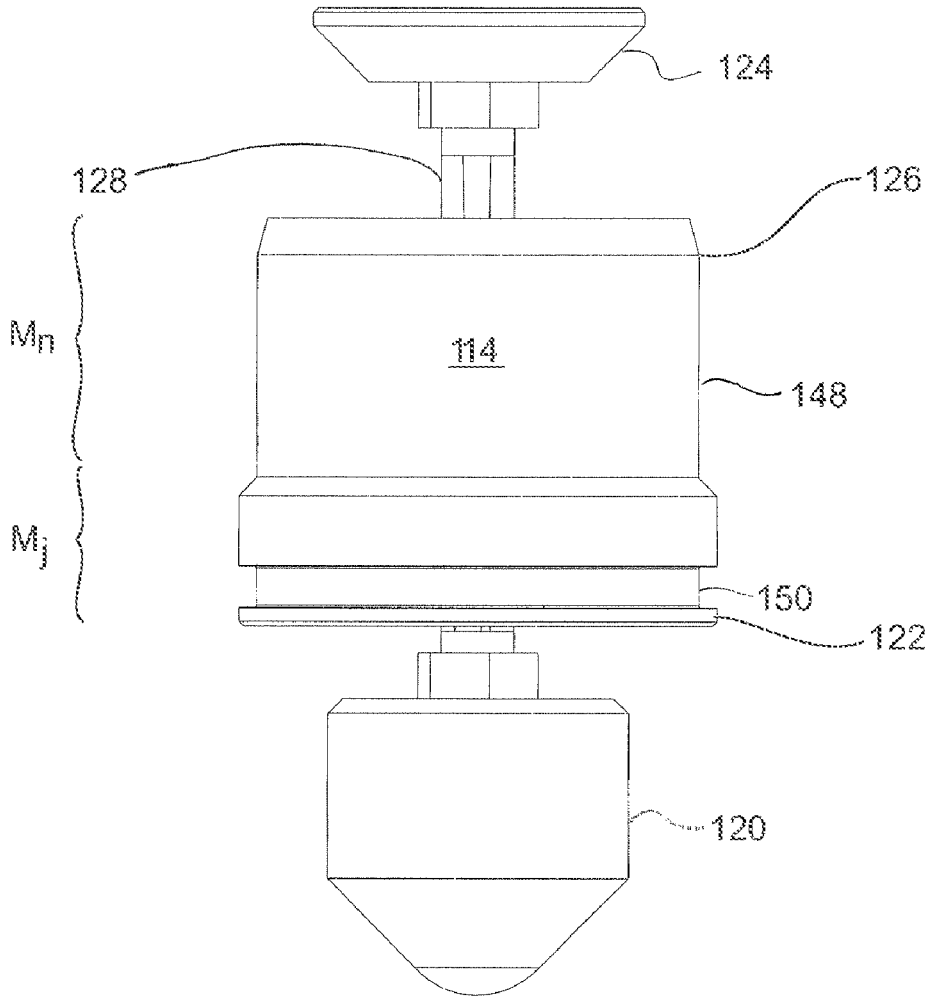
FIG. 7 is a side view of the free floating check valve assembly of FIG. 4 in the sleeve of FIG. 5.
Figure 8:
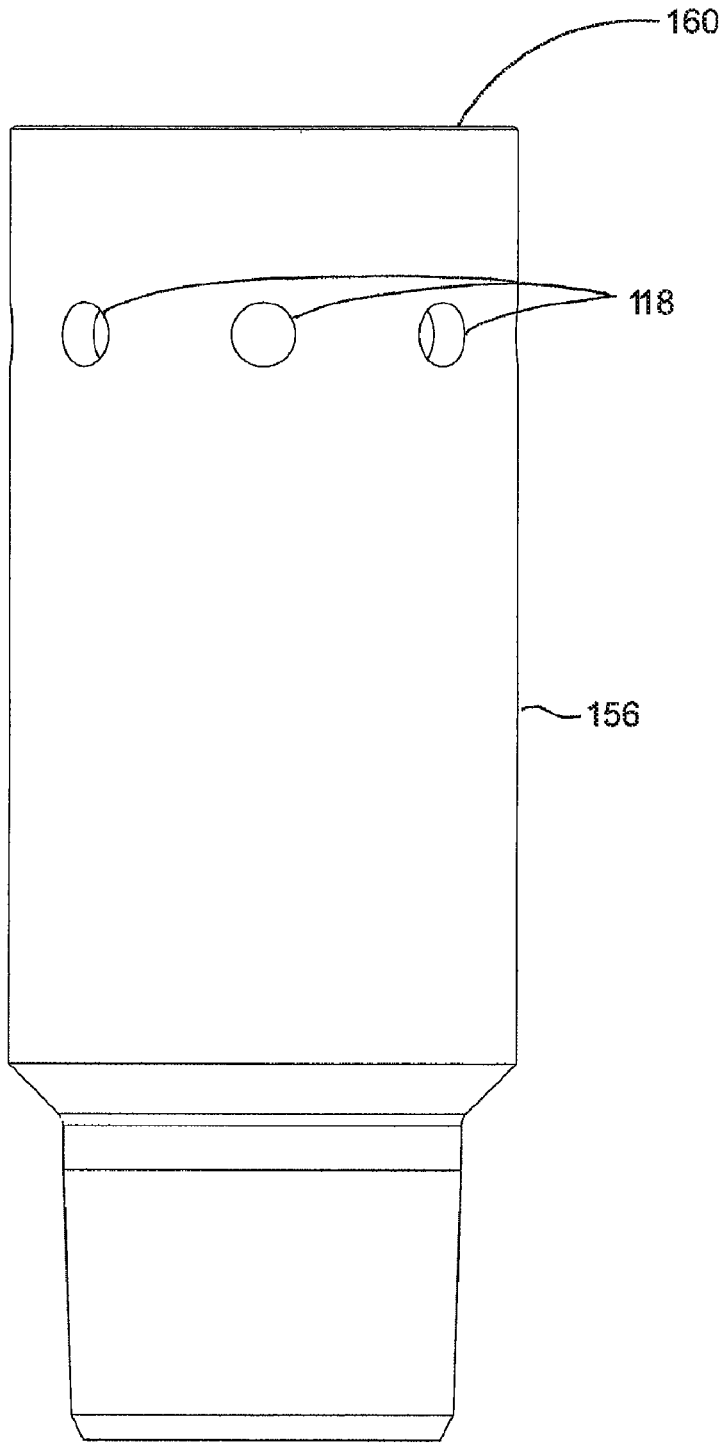
FIG. 8 is a side view of a lower housing section of the drain valve of FIG. 2A, illustrating a plurality of drain ports formed thereabout.
Figure 9:
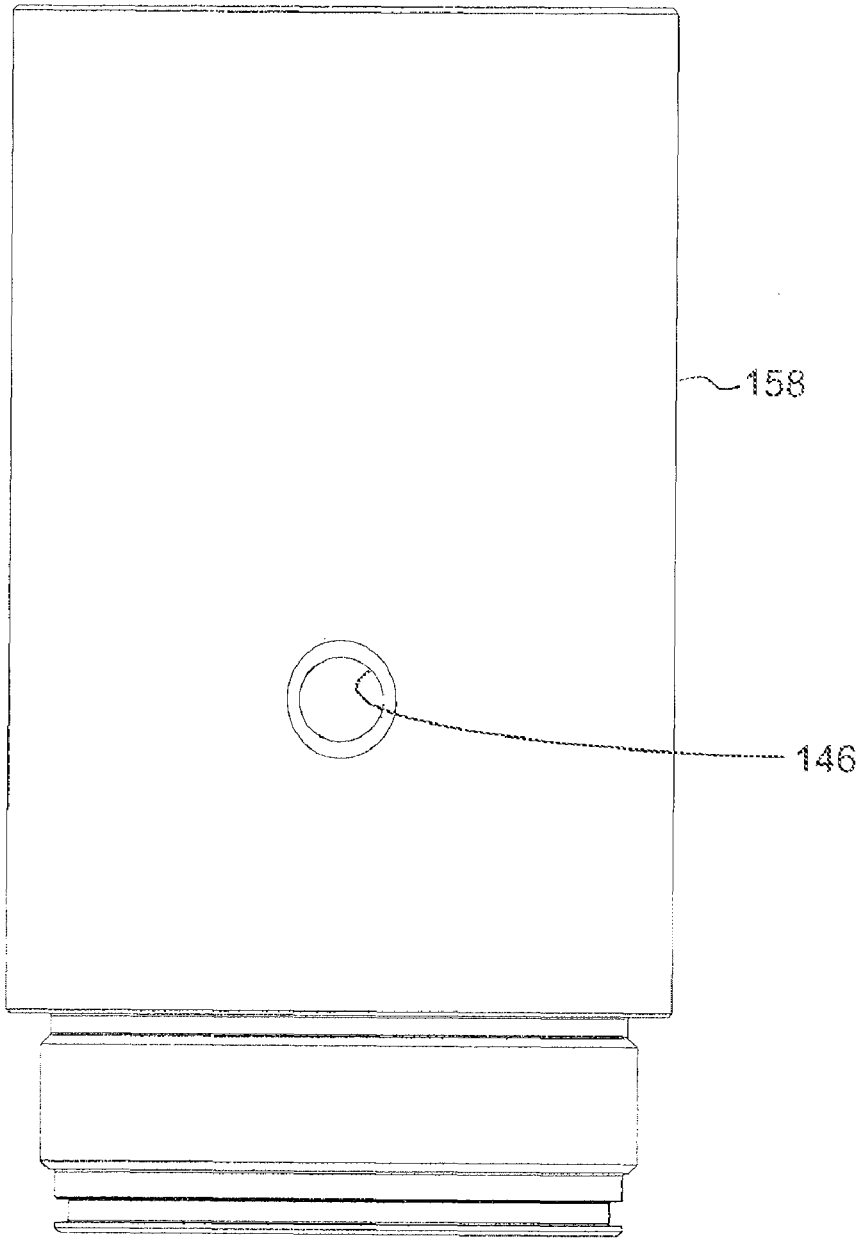
FIG. 9 is a side view of an upper housing section of the drain valve of FIG. 2A illustrating a opening for mounting a tag bar thereacross to stop upward travel of the check valve assembly therein.

As shown in FIGS. 5-7, the sleeve 114 further comprises a tubular sleeve body 115 having a central bore 116 and a central support 132, supported in the central bore 116 for guiding the axially, freely-moveable valve stem 128 therein. A flow passage 134 is formed circumferentially about the sleeve's central support 132. The flow passage 134, which may be a plurality of flow ports, permits pumped fluids to flow through the sleeve 114 when the drain valve 100 is in the production position.

Figure 2A:
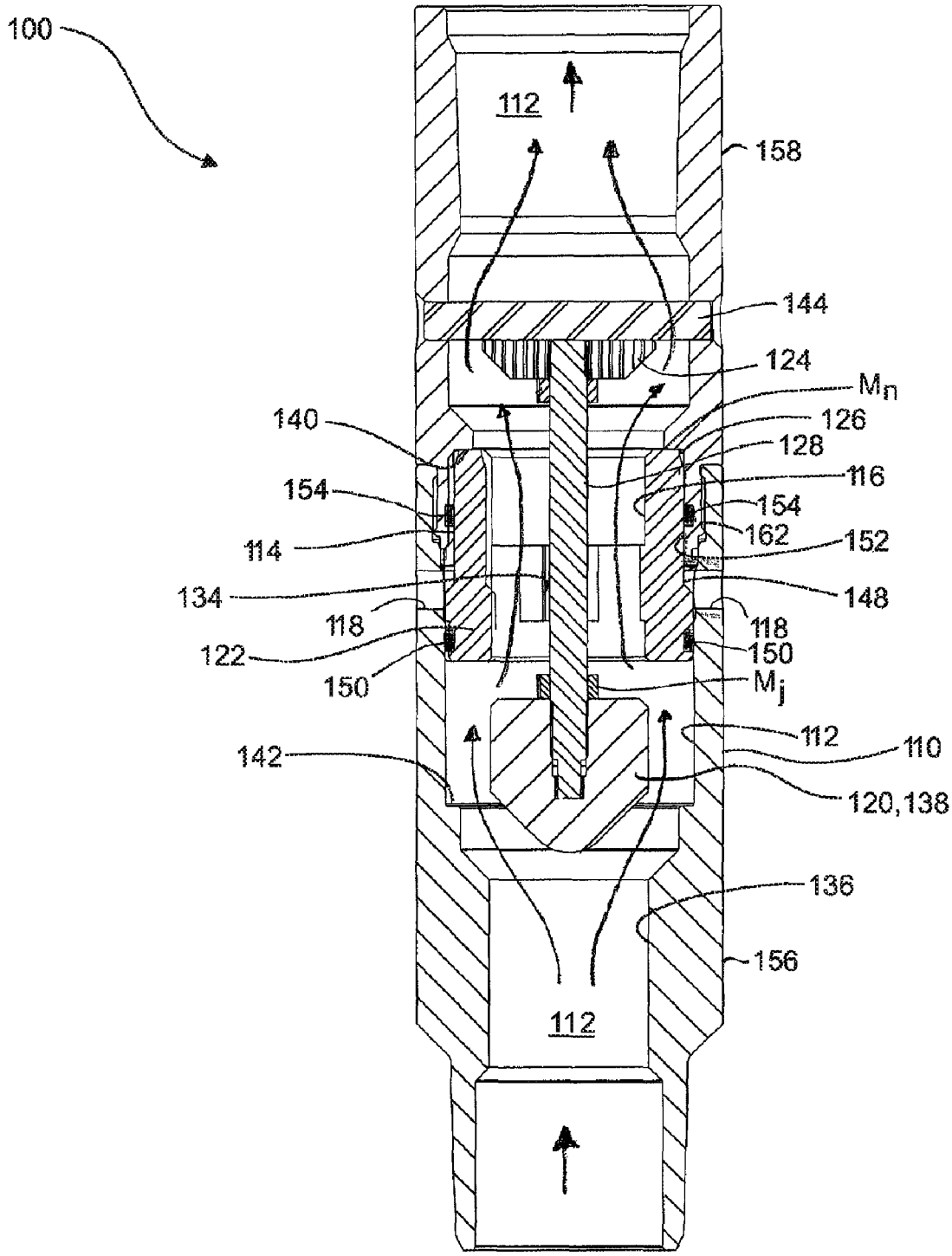
FIG. 2A is a longitudinal sectional view of a drain valve according to an embodiment of the invention, the valve being shown in a production position.

As seen in FIG. 2A, and in one embodiment, a downhole portion of the valve's bore 112 has a reduced diameter 136 and the first check valve 120 is sized to seal therein for forming a check valve piston 138 in the drain position. Discharge from the pump acts on the check valve piston 138 to drive the check valve piston 138 uphole out of the reduced diameter 136 to engage the downhole end 122 of the sleeve 114 for forming the downhole piston face DH.

Having reference to FIGS. 2A, 2B, 3, 8 and 9, the housing 110 comprises an uphole shoulder 140 spaced from a downhole shoulder 142 for limiting the maximal extent of the axial reciprocating movement of the sleeve 114 between the production position and the drain position.

The housing 110 further comprises a stop 144 positioned above the uphole shoulder 140. The stop 144 engages the second check valve 124 of the check valve assembly 130 for arresting the uphole movement of the first check valve 120 connected thereto, before the sleeve 114 reaches the uphole shoulder 140. This results in the sleeve 114 being able to continue to move uphole and unseal from the first check valve 120 in the production position for permitting flow of fluids thereby. The position of the stop 144 and the uphole shoulder 140 the spacing of the first and second check valves 120, 124 and the spacing of the uphole and downhole ends 126,122 of the sleeve 114 co-operate to enable: the first check valve 120 to seal at the downhole end 126 of the sleeve 144 or the second check valve 124 to seal at the uphole end 122 of the sleeve 114 and for neither the uphole end 126 or the downhole end 122 of the sleeve 114 to be sealed to the check valve assembly 130 in the production position.

Figure 3:
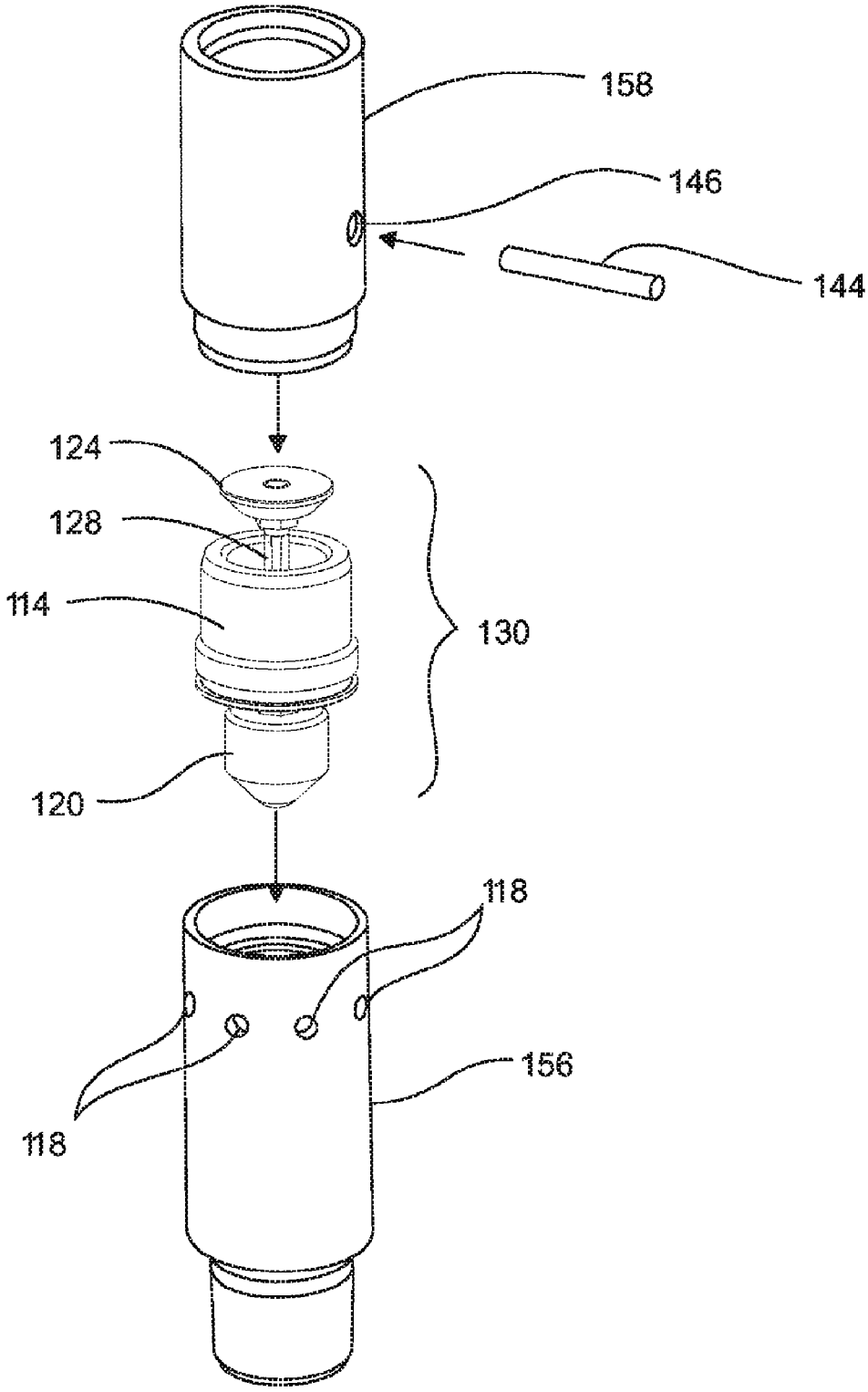
FIG. 3 is an exploded perspective view of the drain valve according to FIG. 2A
Figure 4:
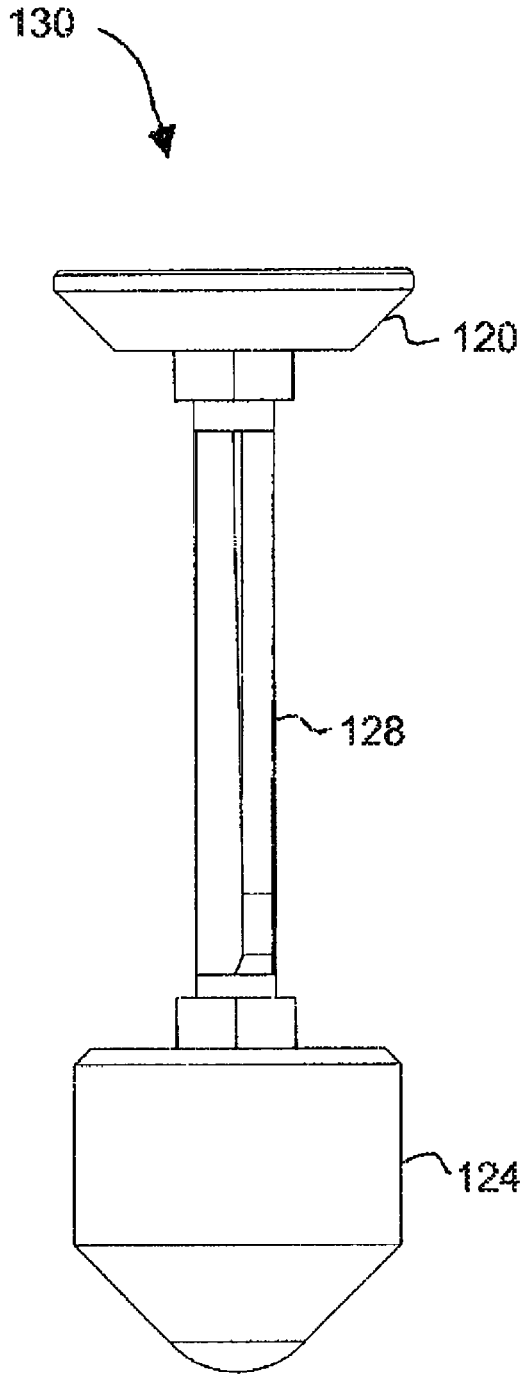
FIG. 4 is a side view of a free floating check valve assembly axially moveable within the drain valve according to FIG. 2A.

Having reference to FIG. 3, the stop 144 is a tag bar positioned across the valve bore 112 of the housing 110. The tag bar 144 is typically inserted into the housing 110 through mounting holes 146 in the housing's wall.

As shown in FIGS. 2A and 7, embodiments of the invention incorporate a unique sealing arrangement for sealing above and below the one or more drain ports 118 in the production position and below the one or more drain ports 118 in the drain position. The sleeve 114 has a stepped outer wall 148, which forms a major diameter Mj at the downhole end 122 and a minor diameter Mn at the uphole end 126. A seal 150 is housed in the major diameter Mj of the sleeve 114 to seal between the sleeve 114 and the housing 110 at a corresponding major diameter 115 in the valve bore 112. The seal 150 remains below the one or more drain ports 118 during reciprocation of the sleeve 114 between the production position and the drain position. The housing 110 is stepped inwardly above the one or more drain ports for forming a corresponding minor or reduced diameter 152. A seal 154 is positioned between the sleeve's minor diameter Mn and the valve bore 116. As shown in FIG. 2A, the seal 154 is housed in the housing's reduced diameter 152 to seal against the minor diameter Mn of the sleeve 114 when the sleeve 114 is moved uphole to the production position. Thus, sliding contact between the seals 150,154 and the one or more drain ports 118, which could act to prematurely wear the seals, is avoided.

As shown in FIGS. 2A, 2B, 3, 8 and 9, in embodiments of the invention for the purposes of manufacture, the housing 110 comprises a lower tubular housing 156 and an upper tubular housing 158. The upper and lower housings 156,158 together define the valve's bore 112, in which the sleeve 114 and check valve assembly 130 are mounted.

In one embodiment best seen in FIGS. 2A, 3, 8 and 9, the lower housing 156 comprises the one or more drain ports 118 formed adjacent an uphole end 160, the downhole shoulder 142 and the downhole reduced diameter portion 136. The upper housing 158 comprises the inwardly stepped, reduced diameter 152 at a downhole end 162 which houses the seal 154 which engages the sleeve's minor diameter Mn, the uphole shoulder 140 and the mounting holes 146 for the tag bar 144, positioned thereabove.

Figure 2B:
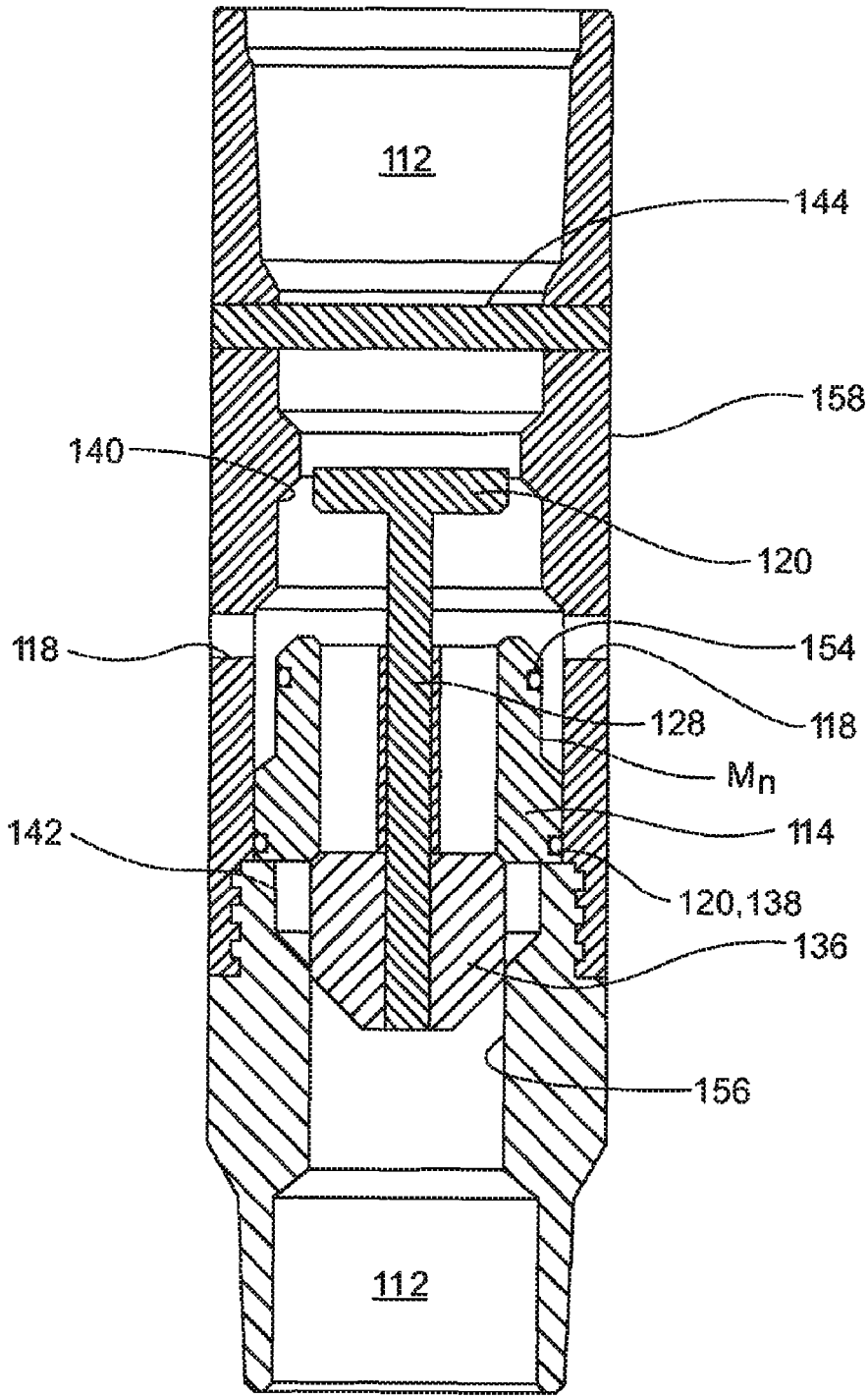
FIG. 2B is a longitudinal sectional view of a drain valve according to another embodiment of the invention, the first check valve being shown blocking a bore of the housing.

FIG. 2B illustrates another embodiment for manufacture of the housing 120 wherein the lower housing 156 comprises the downhole reduced diameter bore portion 136 and forms the downhole shoulder 142. The upper housing 158 comprises the one or more drain ports 118 and the uphole shoulder 140. The seal 154 is housed about the minor diameter Mn of the sleeve 114 which seals to the housing's reduced diameter 152, above the one or more drain ports 118.

In Operation

In operation, as illustrated in FIGS. 10A to 10F, embodiments of the drain valve 100 operatively shift between a drain position (FIG. 10B) and a production position (FIG. 10F), substantially through fluid actuation.

Figure 10C:
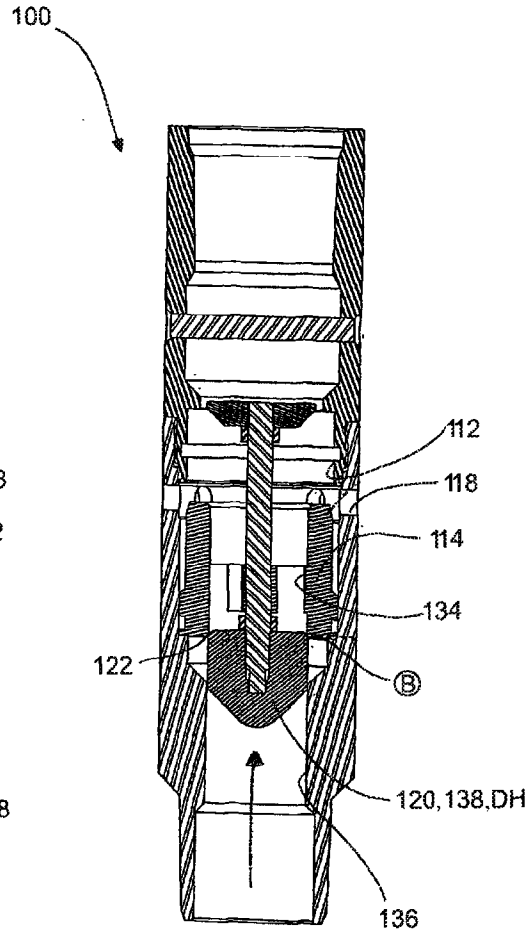
FIGS. 10A-10F are cross-sectional views of the drain valve according to FIG. 2A in operation and illustrating axial movement of the free floating check valve assembly and the sleeve therein as a result of pressure differentials between the pump discharge therebelow and the hydrostatic head in a production tubing string thereabove; more particularly
Figure 10B:
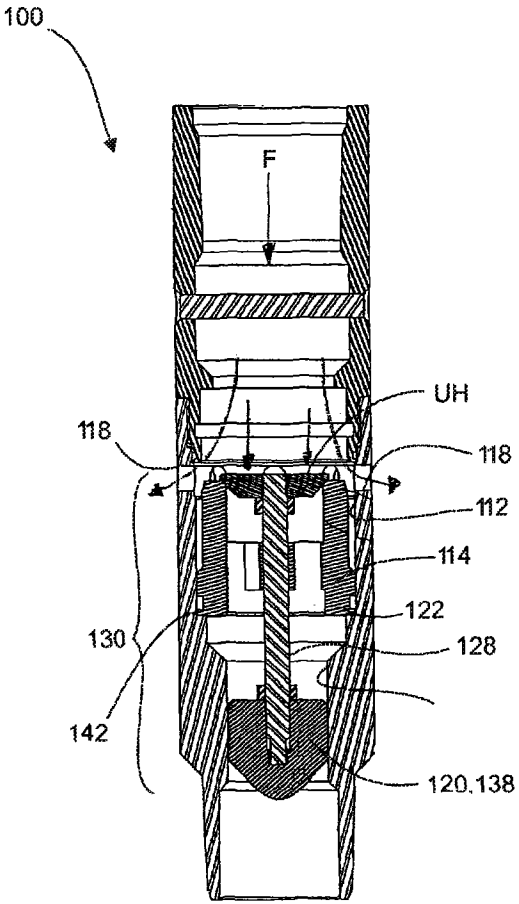
Figure 10A:
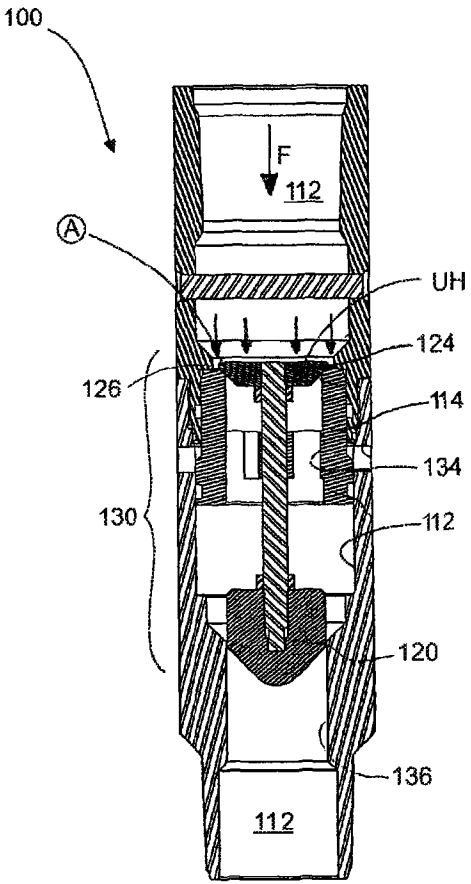

As shown in FIG. 10A, after the pump is stopped, the second check valve 124, is moved downhole to engage the uphole end 126 of the sleeve 114. The second check valve 124 and the sleeve 114 form the uphole piston face UH which seals the flow passage 134 of the central bore 116 through the sleeve 114 and therefore seals the valve' bore 112 therebelow.

As shown in FIG. 10B, produced fluid F in the production tubing above the uphole piston face UH acts at the uphole piston face UH to shift the sleeve 114 downhole to open the one or more drain ports 118. The produced fluid F is drained through the one or more open drain ports 118 to the annulus thereabout.

As shown in FIG. 10C, when the pump is operating, fluid is received from the pump and the first check valve 120 is shifted uphole to engage the downhole end 122 of the sleeve 114 for forming the downhole piston face DH. In the case of a reduced diameter 136, the fluid positively drives the first check valve 120 out of the reduced diameter 136 to engage the sleeve 114. The downhole piston face DH seals the flow passage 134 through the sleeve 114 and the valve bore 112 thereabove.

Figure 10F:
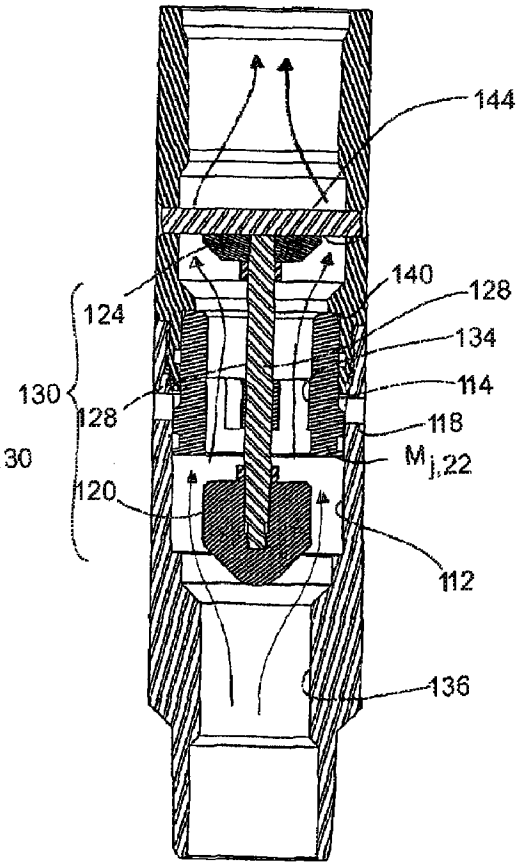
Figure 10E:
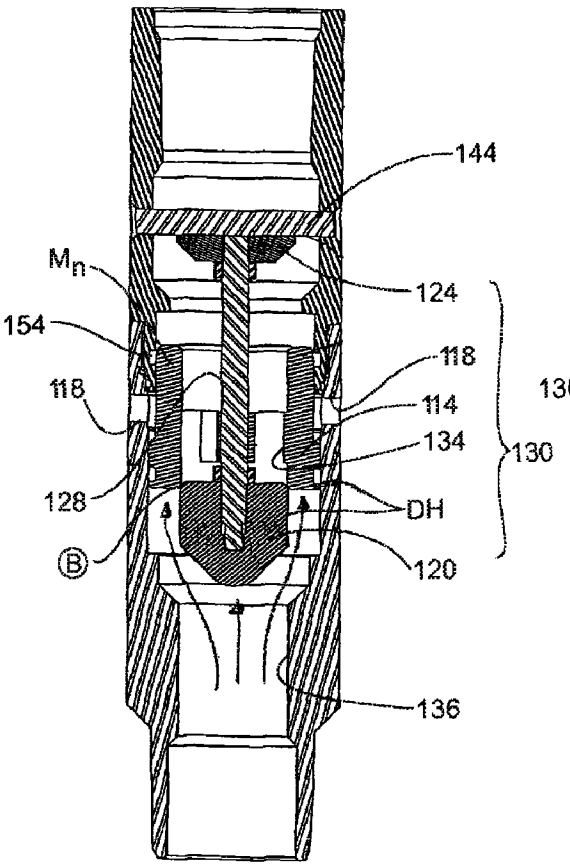
Figure 10D:
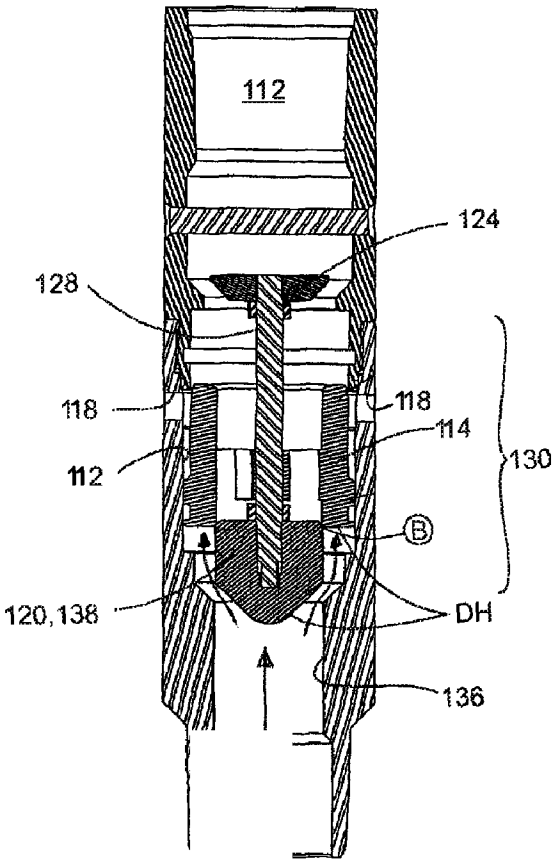

As shown in FIG. 10D, fluid from the pump acts at the downhole piston face DH to lift the sleeve 114 uphole to block the one or more drain ports 118.

As shown in FIG. 10E, the sleeve 114 engages the upper seal 154 to seal against the housing 110 above the one or more drain ports 118 and thereafter, uphole movement of the first check valve 120 is arrested.

As shown in FIG. 10F, thereafter the sleeve 114 is further shifted axially uphole to unseal from the first check valve 120 for opening the flow passage 134. Fluid from the pump flows uphole through the flow passage 134 to the production tubing thereabove.

The method is described herein in greater detail for an embodiment wherein the first and second check valves 120, 124 are spaced apart by the valve stem 128, forming the check valve assembly 130.

After the pump[is stopped (FIG. 10A), the check valve assembly 130, having been restrained at the tag bar 144 during production, is caused to move downhole such as by gravity or under the influence of produced fluid F received from the production tubing S thereabove. The second check valve 124 engages (A) the sleeve's uphole end 126, forming the uphole piston face UH. The produced fluid F in the production tubing thereabove acts at the uphole piston face UH to create a force for moving the check valve assembly 130 and sleeve 114 downhole as a unitary piston.

Having reference to FIG. 10B, the valve 100 is shown in the drain position. The sleeve 114 and check valve assembly 130 are shifted downhole until the sleeve's downhole end 122 engages the downhole shoulder 142 in the valve bore 112. The one or more drain ports 118 are opened to permit the produced fluid F to drain from the production tubing to the annulus. The first check valve 120 seals in the downhole, reduced diameter portion 136 of the valve bore 112 forming the check valve piston 138 therein.

As shown in FIG. 10C, when the pump is started and is operating, the discharge fluid flow from the pump is received and acts at the check valve piston 138, positioned below the sleeve 114, to shift the check valve assembly 130 axially uphole until the first check valve 120 engages (B) the downhole end 122 of the sleeve 114 forming the downhole piston face DH.

Having reference to FIG. 10D, the discharge fluid from the pump continues to act at the check valve piston 138 to shift the sleeve 114 and the check valve assembly 130 axially uphole within the valve bore 112. The check valve piston 138 moves uphole out of the reduced diameter portion 136 of the valve bore 112. Thereafter, the discharge fluid acts at the downhole piston face DH created by the engagement (B) of the first check valve 120 with the downhole end 122 of the sleeve 114.

As shown in FIG. 10E, the discharge fluid continues to act at the downhole piston face DH to shift the check valve assembly 130 and sleeve 114 uphole to block the one or more drain ports 118. The sleeve 114 seals to the housing 110 at seal 154 thereabove. Thereafter, the second check valve 124 engages (C) the tag bar 144, arresting further uphole movement of the check valve assembly 130. The first check valve 120 remains engaged at the downhole end 122 of the sleeve 114, preventing flow of discharge fluids through the sleeve's flow passage 134.

Thereafter, as shown in FIG. 10F, the discharge from the pump acts at the major diameter Mj at the downhole end 122 of the sleeve 114 to shift the sleeve 114 axially uphole, independent of the check valve assembly 130. The sleeve 114 is shifted uphole until the sleeve's uphole end 126 engages the uphole shoulder 140 (D) in the valve bore 112, the sleeve 114 unsealing from the first check valve 120 for opening the flow passage 134 through the sleeve 114.

The valve stem 128 is of sufficient length such that when the second check valve 124 has engaged the tag bar 144 and the sleeve 114 has engaged the uphole shoulder 140, both the first and second check valves 120,124 are spaced from the downhole and uphole ends 122,126 of the sleeve 114, opening the flow passage 134 therethrough. Thus, discharge flow from the pump is permitted to flow past the first check valve 120 into the fluid ports 134 in the sleeve 114 and from the fluid ports 134 in the sleeve 114 past the second check valve 124 to the production tubing S thereabove.

In an embodiment of the invention, as the sleeve 114 is moved axially uphole to close the one or more drain ports 118, the minor diameter Mn of the sleeve 114 passes the one or more drain ports 118 without contact. The sleeve 114 remains sealed to the housing 110 at the major diameter Mj, below the one or more drain ports 118 throughout the uphole movement of the sleeve 114. Thus, the life of the seals 150,154 is extended as damage due to engagement of the seals 150,154 with the one or more drain ports 118 is avoided.

EXAMPLE

A tubing drain valve according to an embodiment of the invention is designed for use with 2⅞ inch external upset end (EUE) tubing. The valve is designed to operate at a pressure of 5,000 psi and at a design temperature of 150° F. The design flow rate is 50-1000 bbl/day. The valve is pressure-actuated as discussed herein and the materials for manufacture of the drain valve are selected to be compatible with produced fluids containing at least oil, water, solids, associated gas and $CO_2$.

The embodiments of the invention in which an exclusive property or privilege is claimed are defined as follows:

1. A tubing drain valve for incorporation between a production tubing string and a pump, the tubing drain valve comprising:

a housing having an uphole end for connection to the production tubing string above the pump and a downhole end for connection to the pump, downhole of the housing, the housing having a valve bore in communication with fluid in the tubing string and the pump;

one or more drain ports in the housing communicating with the valve bore;

a sleeve fit to the valve bore and being axially moveable in a reciprocating action in the valve bore, the sleeve having a central bore therethrough;

a first check valve positioned downhole of the sleeve for sealing the central bore at a downhole end of the sleeve for forming a downhole piston face, fluid from the pump acting thereat to lift the sleeve uphole to block the one or more drain ports in a production position; and unsealing from the central bore for permitting fluid to flow therethrough in the production position;

a second check valve positioned above the sleeve for unsealing from the central bore at an uphole end of the sleeve for permitting fluid to flow therethrough in the production position; and sealing the central bore for forming an uphole piston face, fluid in the production tubing string thereabove acting thereat to move the sleeve downhole to open the one or more drain ports in a drain position for draining fluid from the production tubing string therethrough.

2. The tubing drain valve of claim 1 further comprising:

a check valve assembly comprising the first and second check valves and a valve stem, the valve stem extending axially through the sleeve and spacing the first check valve from the second check valve, the check valve assembly being axially moveable within the central bore;

a stop in the valve bore for limiting uphole movement of the check valve assembly; and an uphole shoulder in the valve bore for limiting uphole movement of the sleeve, wherein the stop and the uphole shoulder are positioned, the downhole and up ends of the sleeve are spaced, and the first and second check valves are spaced so that the stop limits uphole movement of the check valve assembly before the uphole shoulder limits uphole movement of the sleeve, unsealing the first check valve and the second check valve from the central bore in the production position.

3. The tubing drain valve of claim 2 wherein the sleeve is sealed to the housing before the uphole movement of check valve assembly is stopped.

4. The tubing drain valve of claim 2 wherein the stop is a tag bar positioned across the valve bore, uphole from the sleeve, for engaging the second check valve.

5. The tubing drain valve of claim 2 wherein the valve bore further comprises:

a downhole shoulder for limiting downhole movement of the sleeve, the downhole shoulder being spaced from the uphole shoulder so as to permit the sleeve to move axially therebetween the production position and the drain position.

6. The tubing drain valve of claim 1 wherein the housing further comprises a downhole portion, the valve bore therein having a reduced diameter; and the first check valve is sized to seal the valve bore within the reduced diameter for forming a check valve piston in the drain position.

7. The tubing drain valve of claim 1 further comprising:

a major diameter at the downhole end of the sleeve and a corresponding major diameter in the valve bore; and a seal in the major diameter of the sleeve for sealing to the valve bore, the major diameter of the sleeve being located below the one or more drain ports in the production position and in the drain position.

8. The tubing drain valve of claim 7 further comprising:

a minor diameter at the uphole end of the sleeve and a corresponding minor diameter in the valve bore uphole of the one or more drain ports; and a seal between the minor diameter of the sleeve and the valve bore in the production position.

9. The tubing drain valve of claim 2 wherein the sleeve further comprises:

a tubular sleeve body having the central bore formed therethrough;

a central support across the central bore for guiding the valve stem of the check valve assembly for axial movement therein; and a plurality of fluid ports formed in the central bore between the tubular sleeve body and the central support for permitting flow of fluid therethrough in the production position.

10. A method for operating a tubing drain valve, positioned between a production tubing string and a pump, for blocking one or more drain ports in a valve housing in a production position for producing fluid through a valve bore in the housing when the pump is operating and opening the one or more drain ports in a drain position for draining fluid from the production tubing when the pump is stopped, the method comprising:

receiving fluid from the pump when operating the pump to flow fluid uphole;

shifting a first check valve axially uphole to seal a central bore of a sleeve housed in the valve bore at a downhole end of the sleeve, for forming a downhole piston face; the fluid acting at the downhole piston face;

lifting the sleeve to move axially uphole within the valve bore to block the one or more drain ports in the production position, arresting the uphole movement of the first check valve; and lifting the sleeve to unseal at least the first check valve from the central bore to permit the fluid to flow therethough receiving fluid from the production tubing when the pump is stopped for ceasing the flow of fluid uphole;

moving a second check valve downhole to seal the central bore at an uphole end of the sleeve and for forming an uphole piston face, fluid in the production tubing thereabove acting at the uphole piston face; and shifting the sleeve downhole to open the one or more drain ports in the drain position.

11. The method of claim 10 wherein the sleeve seals to the valve housing above the one or more drain ports before the uphole movement of the first check valve is arrested.

12. The method of claim 10 wherein receiving fluid from the production tubing when the pump is stopped, further comprises:

shifting the first check valve downhole within a downhole reduced diameter portion of the valve bore in the drain position, the first check valve forming a check valve piston therein.

13. The method of claim 12 wherein shifting the first check valve axially uphole further comprises:

receiving fluid from the pump when operating, the fluid acting at the check valve piston for shifting the first check valve axially uphole to seal the central bore at the downhole end of the sleeve and for forming the downhole piston face.

* * * * *